US009909356B1

(12) United States Patent
O'Keeffe

(10) Patent No.: US 9,909,356 B1
(45) Date of Patent: Mar. 6, 2018

(54) FIRE DOOR

(71) Applicant: William O'Keeffe, Brisbane, CA (US)

(72) Inventor: William O'Keeffe, Brisbane, CA (US)

( * ) Notice: Subject to any disclaimer, the term of this patent is extended or adjusted under 35 U.S.C. 154(b) by 0 days.

(21) Appl. No.: 15/601,824

(22) Filed: May 22, 2017

(51) Int. Cl.
*E06B 5/16* (2006.01)
*E06B 3/58* (2006.01)
*A62C 2/06* (2006.01)

(52) U.S. Cl.
CPC ..... *E06B 5/16* (2013.01); *A62C 2/06* (2013.01); *E06B 3/5892* (2013.01); *E06B 5/162* (2013.01); *E06B 5/164* (2013.01)

(58) Field of Classification Search
CPC . E06B 5/16; E06B 5/162; E06B 5/164; E06B 3/5892
USPC ..... 52/783.13, 784.11–784.13, 784.15
See application file for complete search history.

(56) References Cited

U.S. PATENT DOCUMENTS 4,601,143 A * 7/1986 O'Keefe ..... E06B 5/162 52/171.3
4,888,918 A * 12/1989 Green ..... E06B 5/16 49/501
4,947,606 A * 8/1990 La See ..... E06B 3/5892 49/171
5,347,780 A * 9/1994 Richards ..... B28B 1/525 49/504
2002/0124497 A1* 9/2002 Fortin ..... E06B 5/164 52/232
2006/0248833 A1* 11/2006 Autovino ..... E06B 3/72 52/455

* cited by examiner

*Primary Examiner* — Robert Canfield
(74) *Attorney, Agent, or Firm* — Theodore J. Bielen, Jr.

(57) ABSTRACT

A fire door utilizing a pair of frame members each having cases forming opposing open chambers. The open chambers are filled with fire resistant material and include structural plates that do not contact the cases. Holders attach to the cases support a fire resistant glazing unit.

12 Claims, 3 Drawing Sheets

FIRE DOOR

BACKGROUND OF THE INVENTION

A fire door is generally a door with a fire-resistance rating. Fire rated doors and frames are necessary to keep persons safe and to minimize property damage during a fire. In particular, fire doors are used as part of a passive fire protection system to reduce the spread of fires and smoke between separate compartments of a structure and to allow persons within such structure to egress safely from a building or other structures such as a ship.

Many components of a door assembly must be fire rated to withstand fire for a specified period of time to achieve a fire rating. Such components include, door frames, window frames, hardware, transoms, sidelights, and glazing. For example, reference is made to U.S. Pat. No. 5,910,620 which describes a fire rated glass and method for making the same. In addition, a fire resistive glazing, sold under the designation Superlite II-XL, distributed by O'Keeffe's Inc. of Brisbane, Calif., is capable of obtaining a 60, 90, or 120 minute rating ASTM E119 rating. As heretofore described, it is important that the door frame also meet the guidelines of a particular testing agency to provide a fire rating for the doorset.

A fire door having an economically assembled door frame and fire rated glazing in the formation of a fire rated doorset would be a notable advance in the field of fire resistant building components.

SUMMARY OF THE INVENTION

In accordance with the present invention, a novel and useful fire door is herein provided.

The door of the present invention utilizes a vision panel, window, or lite that is fire rated. In addition, the fire door of the present application also includes a frame member which is constructed with a first case, which may be in the general shape of a "clamshell". The case also possesses a sheet portion and first and second legs that extend from the sheet portion in an orientation which is different than the orientation of the sheet portion. In any case, the sheet portion and the first and second legs form an open chamber. Likewise, a second case in employed and is similarly constructed to the first case by having a sheet portion and a pair of extending legs to form an open second chamber.

At least one plate lies across the first and second open chambers of the pair of cases without contacting either the first or second cases. The plates may be formed of metallic material and, lacking contact with the first and second cases, are not conducting heat across the first and second cases. Moreover, a plurality of structured plates may lie across the first and second open chambers of the opposing cases. A fastener is used to fix the first and second cases to the one plate. Such fastener would preferably penetrate a leg of the first or second case. Moreover, a plurality of such fasteners may be used to hold the first and second legs of the first and second cases to one or more plates lying across the first and second chambers formed by the first and second cases.

A fire resistant filler is also positioned in the first and second chambers and may take the form of gypsum or like material. Such fire resistant filler may be in the form of loose material or material formed into a preformed piece or into multiple preformed pieces.

A holder is also used in the device of the present application and is placed adjacent the first and second cases. The holder is formed or fashioned to provide a recess that is capable of being occupied by the vision panel. A connector fastens the holder to the first and second cases to allow the vision panel to extent outwardly from the one frame member. In addition, a second frame member having a holder is employed to capture the vision panel apart from the first frame member. The second frame member may have a similar structure to the first frame member. Door hardware may be attached to the one frame member while a hinge may be attached to the another frame member to permit operation of the fire door of the present application.

It may be apparent that a novel and useful fire door has been hereinabove described. It is therefore an object of the present application to provide a fire door device that utilizes a fire rated vision panel and is capable of achieving a fire rating.

Another object of the present application is to provide a fire door device in which the vision panel is of relatively large size compared to fire doors of the prior art.

Another object of the present application is to provide a fire door device that may be assembled without welding components together.

A further object of the present application is to provide a fire door device that includes a style of narrower width than fire doors of the prior art.

Yet another object of the present application is to provide a fire door device which is relatively simple to manufacture and assemble.

Another object of the present application is to provide a fire door device which utilizes standard components and is substantially cheaper to manufacture than fire doors of the prior art.

Yet another object of the present application is to provide a fire door device that is capable of stopping smoke and flame to a high degree.

A further object of the present application is to provide a fire door device which includes a frame portion that may be easily cladded with metallic finishes or finishes utilizing other materials such as wood.

The application present other objects and advantages especially as concerns particular characteristics and features thereof which will become apparent as the specification continues.

For a better understanding of the application, reference is made to the following detailed description of the preferred embodiments thereof which should be taken in conjunction with the prior described drawings.

DETAILED DESCRIPTION OF THE PREFERRED EMBODIMENTS

Various aspects of the present application will evolve from the following detailed description of the preferred embodiments which should be referenced to the prior delineated drawings.

Figure 1:
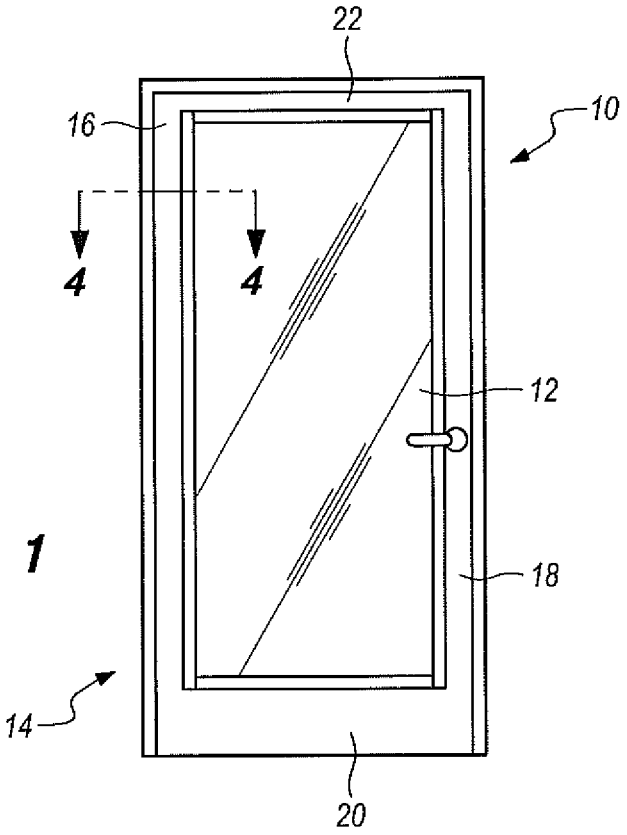
FIG. 1 is a front elevational view of the door device of the present invention.
Figure 2:
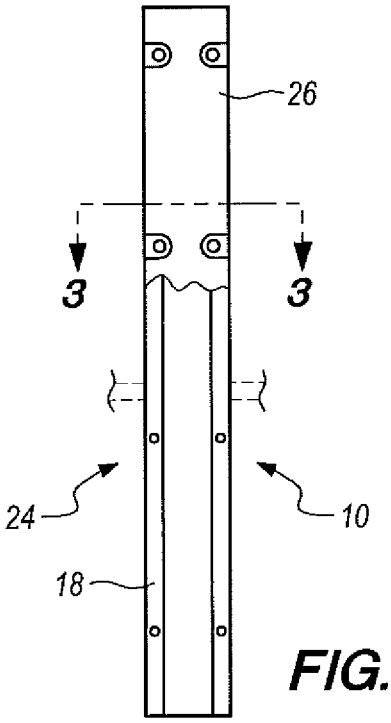
FIG. 2 is a right side view of the door depicted in FIG. 1.

The invention as a whole is shown in the drawings by reference character 10. Fire door 10 includes as one of it elements a vision panel 12, which may also be referred to as a lite, window, and the like. Vision panel 12 is formed of a fire rated glazing unit such as a Superlite II-XL 90, available from O'Keeffe's Inc. of Brisbane, Calif. Fire door 10 also includes a fire rated frame 14 consisting of frame members 16, 18, 20, and 22. Such frame members are similarly constructed. With reference to FIG. 2, it may be observed that end 24 of door 10 is cladded or covered with a closure 25 which may take the form of a stainless steel closure stretch-out. The remaining components of frame member 16 will be discussed hereinafter in detail in FIGS. 3 and 4.

Figure 3:
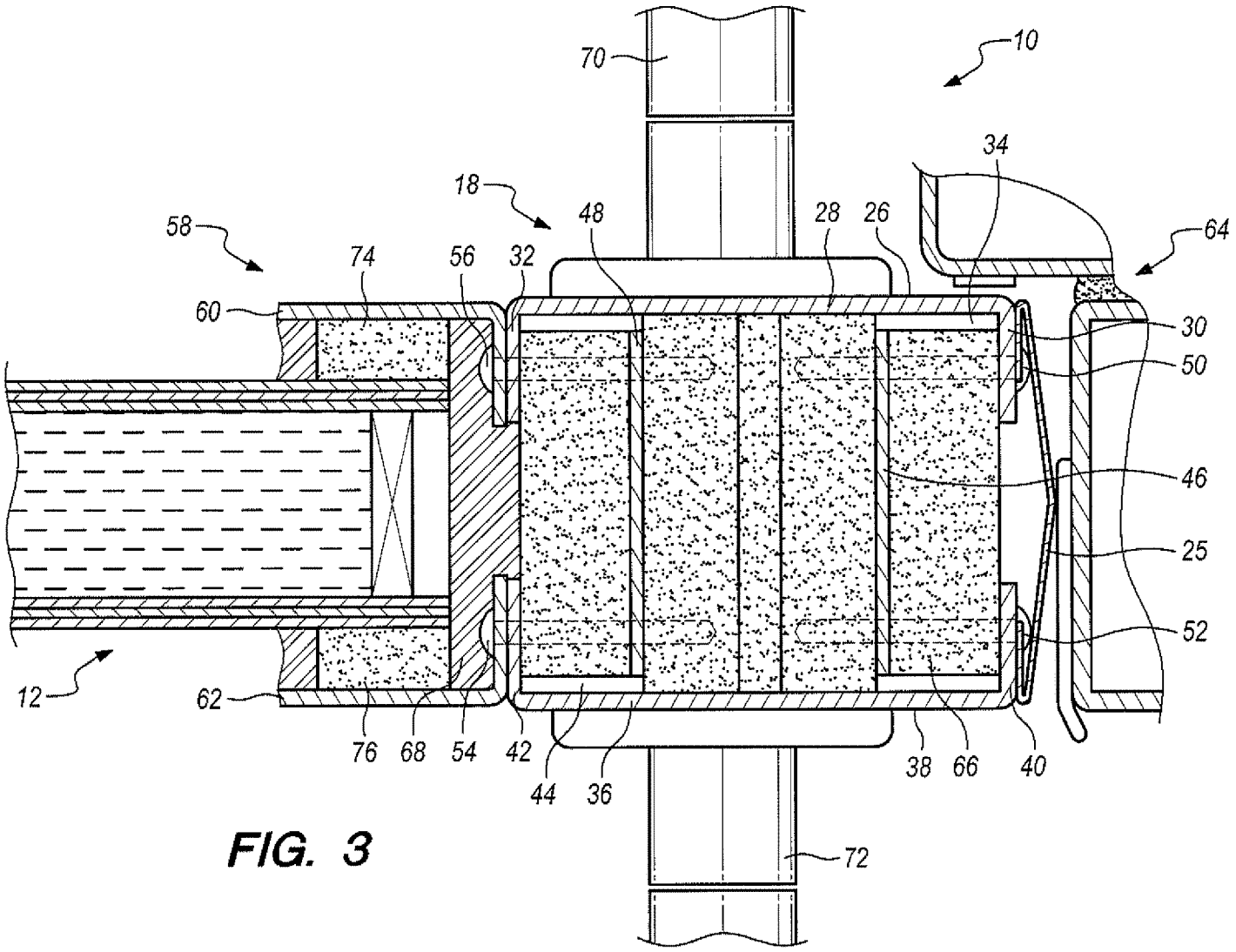
FIG. 3 is a sectional view taken along line 3-3 of FIG. 2.

Turning to FIG. 3, it should be seen that frame member 18 is depicted in section to reveal construction details. Frame member 18 includes a case 26 that is formed with a sheet portion 28 and a pair of legs 30 and 32, angularly extending from sheet portion 28. Legs 30 and 32 are depicted in FIG. 3 as being straight. However, legs 30 and 32 may take other forms such as curved or multi-angled members. Sheet portion 28 and legs 30 and 32 form an open chamber 34.

A second case 36 is also employed in frame member 18 of fire door 10. Second case 36 includes a sheet portion 38 with extending legs 40 and 42. Again, sheet portion 48 and legs 40 and 42 form an open chamber 44. Open chambers 34 and 36 face one another. Metallic plates 46 and 48 lie across open chambers 34 and 44 without contacting cases 26 and 36. Thus, metallic plates 46 and 48 provide part of the structure of frame member 18 without conducting any heat between cases 26 and 36.

Fasteners 50, 52, 54, and 56 fix cases 26 and 36 to plates 46 and 48. Specifically, exemplar fastener 50 extends through leg 30 of case 26 and plate 46. The remaining fasteners 52, 54, and 56 are similarly positioned.

A holder 58 in the form of a pair of angles 60 and 62 are held to legs 32 of case 26 and leg 42 of case 36 by fasteners 56 and 54, respectively. Holder 58 encloses visual panel 12 to allow extension of the same to frame member 16, which will be discussed in detail as the specification continues. In addition, closure 25 is held to cases 26 and 36 by fasteners 50 and 52. Closure 25 extends to building fire barrier jamb components 64.

A fire resistant filler material 66 is positioned or placed between cases 26 and 36 and generally occupies open chambers 34 and 44. Filler material 66 may take the form of a plurality of gypsum board elements or similar fire resistant material. Strip 68 lies against angles 60 and 62 as well as vision panel 12. Strip 68 may be formed of a silicone material such as that known as 795 Dow Corning. Handles 70 and 72 attach to cases 26 and 36, respectively, to allow operation of door 10 relative to jamb components 64. Fire barriers 74 and 76 lie between angles 60 and 62 and vision panel 12. Fire barriers may take the form of a combination of gypsum material and fire resistant silicone.

Figure 4:
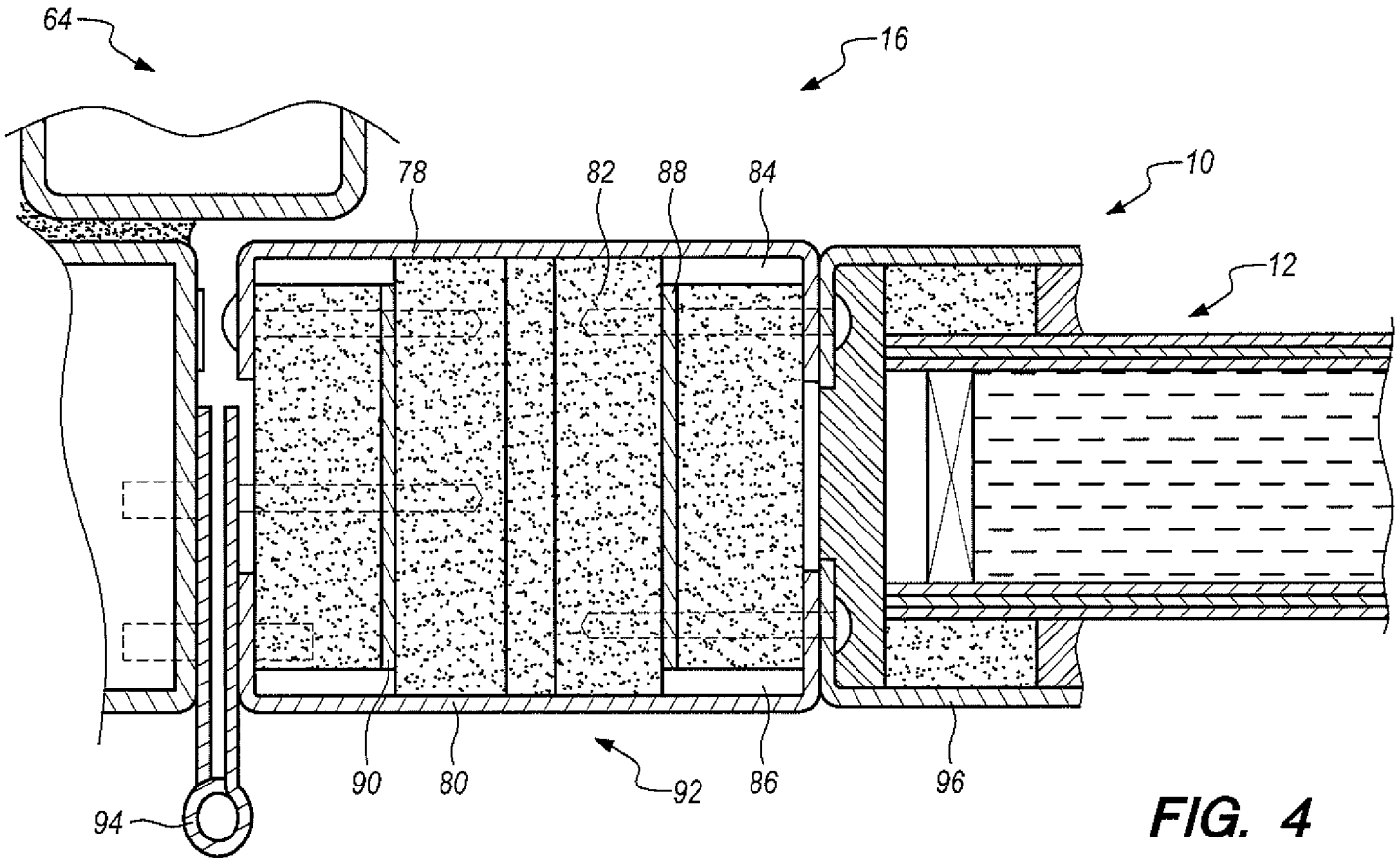
FIG. 4 is a sectional view taken along line 4-4 of FIG. 1.

Turning now to FIG. 4, it may be apparent that frame member 16 is depicted. Frame member 16 is similarly constructed to frame member 18 and includes cases 78 and 80 which are similar to cases 26 and 36 of frame member 18. Filler material 82 lies within open chambers 84 and 86. Structural plates 88 and 90 are held to cases 78 and 80 by plurality of fasteners 92. Again, plates 88 and 90 do not touch cases 78 and 80 in order to prevent thermal conduction therebetween. A hinge 94 is held to case 80 and jamb components 64 to allow the swinging of door 10 once the user operates handle 70 or 72, FIG. 3. The remaining components of frame member 16 are essentially identical to components shown on frame member 18 and will not be discussed further.

In operation, the user assembles door 10 using frame members 16 and 18. Exemplar frame 18 employs cases 26 and 36 to hold fire resistant filler material 66 therebetween, spanning chambers 34 and 44. Structural plates 46 and 48 lie within open chambers 34 and 44 and are held therewithin by plurality of fasteners 50, 52, 54, and 56. Most importantly, plates 46 and 48 do not touch cases 26 and 36 in this assemblage. Fasteners 56 and 62 also supports a holder 58 which captures vision panel 12. Vision panel 12 extends to frame member 16, FIG. 4 and is supported by holder 96 thereof. Holder 96 is fastened to cases 78 and 80 by plurality of fasteners 92. A hinge 94, FIG. 4, is fixed to jamb components 64 and to case 80 which allows door 10 to swing once handle 70 or 72 is operated to release door 10 from jamb component 64, FIG. 3.

While in the foregoing embodiments of the invention have been set forth in considerable detail for the purpose of making a complete disclosure of the invention it may be apparent to those of skills in the art that numerous changes may be made in such details without departing from the spirit and principles of the invention.

What is claimed is:

1. A fire door device having a vision panel, comprising:

one frame member, said one frame member comprising a first case, said first case having a sheet portion and first and second legs connected to said sheet portion, said sheet portion and said first and second legs of said first case forming a first open chamber, and a second case, said second case having a sheet portion and first and second legs connected to said sheet portion, said sheet portion and said first and second legs of said second case forming a second open chamber;

one plate lying across said first and second open chambers without contacting said first and second cases;

a first fastener for fixing said first case to said one plate;

a second fastener for fixing said second case to said one plate;

a fire resistant filler positioned in said first and second open chambers;

one holder, said one holder providing a recess, the vision panel at least partially occupying said recess of said one holder; and said first and second fasteners connecting said one holder to said first and second cases, respectively.

2. The device of claim 1 in which additionally comprises another plate lying across said first and second open chambers without contacting said first and second cases, and third and fourth fasteners for fixing said first and second cases, respectively, to said another plate.

3. The device of claim 1 in which said first and second fasteners are oriented to fix said first legs of said first and second cases, respectively, to said one plate.

4. The device of claim 2 in which said third and fourth fasteners are oriented to fix said second legs of said first and second cases, respectively, to said another plate.

5. The device of claim 4 which additionally comprises a closure element, said closure element overlapping said first and second cases outside said first and second open chambers.

6. The device of claim 5 in which said third and fourth fasteners are configured to fix said closure element to said first and second cases.

7. The device of claim 1 which further comprises a handle, said handle being mounted to said one frame member.

8. The device of claim 1 which additionally comprises one layer of fire resistant material interposed said vision panel and said one holder.

9. The device of claim 1 which further comprises another frame member, said another frame member comprising a third case, said third case having a sheet portion and first and second legs connected to said sheet portion, said sheet portion and said first and second legs of said third case forming a third open chamber, and a fourth case, said fourth case having a sheet portion and first and second legs connected to said sheet portion, said sheet portion and said first and second legs of said fourth case forming a fourth open chamber;

yet another plate lying across said third and fourth open chambers without contacting said third and fourth cases' one and another fasteners for fixing said third and fourth cases, respectively, to said yet another plate;

a fire resistant mass positioned in said third and fourth chambers;

another holder, said another holder providing a recess, the vision panel at least partially occupying said recess of said another holder; and said one and another fasteners fastening said another holder to said third and fourth cases, respectively.

10. The device of claim 9 which additionally comprises another layer of fire resistant material interposed said vision panel and said another holder.

11. The device of claim 9 which additionally comprises a hinge mounted to said another frame member.

12. The device of claim 9 in which said one and another frame members lie apart from one another and sandwich the vision panel therebetween.

* * * * *